US009709942B2

(12) United States Patent
Tanaka

(10) Patent No.: US 9,709,942 B2
(45) Date of Patent: Jul. 18, 2017

(54) IMAGE FORMING APPARATUS WITH AN IMPROVED NOISE ADDING UNIT TO ADD A NOISE PATTERN TO A PRINTED IMAGE

(71) Applicant: KYOCERA Document Solutions Inc., Osaka (JP)

(72) Inventor: Koichi Tanaka, Osaka (JP)

(73) Assignee: Kyocera Document Solutions, Inc. (JP)

( * ) Notice: Subject to any disclaimer, the term of this patent is extended or adjusted under 35 U.S.C. 154(b) by 0 days.

(21) Appl. No.: 14/952,081

(22) Filed: Nov. 25, 2015

(65) Prior Publication Data

US 2016/0179045 A1 Jun. 23, 2016

(30) Foreign Application Priority Data

Dec. 22, 2014 (JP) ..... 2014-259436

(51) Int. Cl.
*G03G 15/00* (2006.01)

(52) U.S. Cl.
CPC ..... *G03G 15/553* (2013.01)

(58) Field of Classification Search
CPC ..... G03G 15/553
See application file for complete search history.

(56) References Cited

U.S. PATENT DOCUMENTS 5,606,432 A 2/1997 Ohtsuka et al.
6,625,327 B1 * 9/2003 Ohshima ..... H04N 1/4053 358/3.22
2013/0287313 A1 * 10/2013 Marchessoux ..... G09G 5/10 382/274

FOREIGN PATENT DOCUMENTS

| | | |
|---|---|---|
| JP | H07-231393 | 8/1995 |
| JP | H08-251413 | 9/1996 |
| JP | 2008-085564 | 4/2008 |
| JP | 2010-206703 | 9/2010 |

* cited by examiner

*Primary Examiner* — Christopher D Wait

(57) ABSTRACT

An image forming apparatus includes a noise adding unit and a controller. The noise adding unit is configured to add a noise pattern to a print image. The controller is configured to perform printing of the print image in which the noise pattern has been added. The noise pattern is a pattern obtained by two-dimensionally arranging plural noises of which each has a local planar distribution. Each of the plural noises has a local planar distribution in which pixel values monotonically vary with a distance from a pixel having a peak pixel value.

3 Claims, 6 Drawing Sheets

FIG. 4

| | | | | | | | |
|---|---|---|---|---|---|---|---|
| 0 | 4 | 8 | 12 | 16 | 20 | 24 | 28 |
| 108 | 112 | 116 | 120 | 124 | 128 | 132 | 32 |
| 104 | 188 | 192 | 196 | 200 | 204 | 136 | 36 |
| 100 | 184 | 236 | 240 | 244 | 208 | 140 | 40 |
| 96 | 180 | 232 | 252 | 248 | 212 | 144 | 44 |
| 92 | 176 | 228 | 224 | 220 | 216 | 148 | 48 |
| 88 | 172 | 168 | 164 | 160 | 156 | 152 | 52 |
| 84 | 80 | 76 | 72 | 68 | 64 | 60 | 56 |

IMAGE FORMING APPARATUS WITH AN IMPROVED NOISE ADDING UNIT TO ADD A NOISE PATTERN TO A PRINTED IMAGE

CROSS-REFERENCE TO RELATED APPLICATIONS

This application relates to and claims priority rights from Japanese Patent Application No. 2014-259436, filed on Dec. 22, 2014, the entire disclosures of which are hereby incorporated by reference herein.

BACKGROUND

1. Field of the Present Disclosure

The present disclosure relates to an image forming apparatus.

2. Description of the Related Art

In an image forming apparatus that includes an electrographic development system, a printing density characteristic (i.e. a characteristic of printing densities for pixel values of image data) is changed owing to aging of the development system such as a photoconductor drum.

FIG. 6 shows a diagram that explains change of a printing density characteristic due to aging of a development system.

Originally as indicated by a dashed line in FIG. 6, it is favorable that the printing density is linear to pixel values of an image to be printed. However, as indicated by a solid line in FIG. 6, gradation in a low density range and a high density range is lost owing to aging of the development system.

Some image forming apparatuses use gamma correction for restraining effect due to such change of the characteristic.

For restraining effect due to such change of the aforementioned characteristic using gamma correction, it is required to perform calibration for determining a characteristic of the gamma correction. In the calibration, patch images are developed, toner densities of the patch images are measured using a density sensor, and a characteristic of the gamma correction is determined on the basis of the measurement result.

However, it takes a long time for the calibration, and in a machine of a machine type that includes no density sensors, it is difficult to perform the calibration.

SUMMARY

An image forming apparatus according to an aspect of the present disclosure includes a noise adding unit and a controller. The noise adding unit is configured to add a noise pattern to a print image. The controller is configured to perform printing of the print image in which the noise pattern has been added. The noise pattern is a pattern obtained by two-dimensionally arranging plural noises of which each has a local planar distribution. Each of the plural noises has a local planar distribution in which pixel values monotonically vary with a distance from a pixel having a peak pixel value.

These and other objects, features and advantages of the present disclosure will become more apparent upon reading of the following detailed description along with the accompanied drawings.

BRIEF DESCRIPTION OF THE DRAWINGS

FIG. 4 shows a diagram that indicates an example of a shape of the noise added by a noise adding unit 23 shown in FIG. 2;

DETAILED DESCRIPTION

Hereinafter, an embodiment according to aspects of the present disclose will be explained with reference to drawings.

Figure 1:
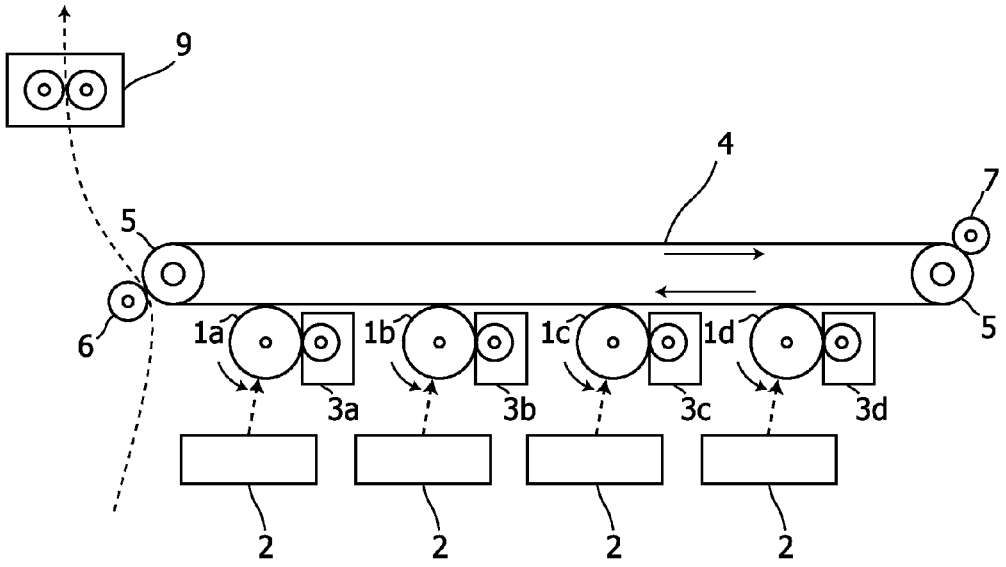
FIG. 1 shows a side view that indicates an internal mechanical configuration of an image forming apparatus in an embodiment according to the present disclosure.

FIG. 1 shows a side view that indicates an internal mechanical configuration of an image forming apparatus in an embodiment according to the present disclosure. The image forming apparatus shown in FIG. 1 is an apparatus having a printing function such as a printer, a facsimile machine, a copier, or a multi function peripheral.

The image forming apparatus in the present embodiment has a tandem-type color development device. This color development device has photoconductor drums 1*a* to 1*d*, an exposure device 2, and development units 3*a* to 3*d*. The photo conductor drums 1*a* to 1*d* are four color photo conductors of Cyan, Magenta, Yellow and Black. For instance, the photoconductor drums 1*a* to 1*d* are made of amorphous silicon.

The exposure device 2 is a device that forms an electrostatic latent image by irradiating laser light to each of the photoconductor drums 1*a* to 1*d*. The laser light is scanned in the direction (the primary scanning direction) perpendicular to the rotation direction (the secondary scanning direction) of the photo conductor drum 1*a*, 1*b*, 1*c* or 1*d*. The exposure device 2 has a laser diode as a light source of the laser light, optical elements (such as lens, mirror and polygon mirror) that guide the laser light to each of the photoconductor drums 1*a* to 1*d*.

Further, in the periphery of each one of the photo conductor drums 1*a* to 1*d*, a charging unit such as scorotron, a cleaning device, a static electricity eliminator and so on are disposed. The cleaning device removes residual toner on each one of the photo conductor drums 1*a* to 1*d* after primary transfer. The static electricity eliminator eliminates static electricity of each one of the photo conductor drums 1*a* to 1*d* after primary transfer.

The development unit 3*a*, 3*b*, 3*c* or 3*d* includes a toner cartridge and a development device. The toner cartridge contains toner of one of four colors: Cyan, Magenta, Yellow, and Black. The toner is supplied from a toner hopper in the toner cartridge to the development device. The development device adheres the toner on the photoconductor drum 1*a*, 1*b*, 1*c*, or 1*d*. The development device 3*a*, 3*b*, 3*c*, and 3*d* forms a toner image by adhering the toner to an electrostatic latent image on the photoconductor drum 1*a*, 1*b*, 1*c*, or 1*d*. An unshown toner conveyance unit is driven by a driving device such as a motor and conveys the toner from the toner hopper to the development device.

The photoconductor drum 1*a* and the development unit 3*a* performs development of Magenta. The photoconductor drum 1*b* and the development unit 3*b* performs development of Cyan. The photoconductor drum 1*c* and the development unit 3*c* performs development of Yellow. The photoconductor drum 1*d* and the development unit 3*d* performs development of Black.

The intermediate transfer belt 4 is a loop-shaped image carrier and intermediate transfer member, and contacts the photoconductor drums 1*a* to 1*d*. Toner images on the photoconductor drums 1*a* to 1*d* are primarily transferred onto the intermediate transfer belt 4. The intermediate transfer belt 4 is hitched round driving rollers 5, and rotates by driving force of the driving rollers 5 towards the direction from the contact position with the photoconductor drum 1*d* to the contact position with the photoconductor drum 1*a*.

A transfer roller 6 makes a conveyed paper sheet contact the transfer belt 4, and secondarily transfers the toner image on the transfer belt 4 to the paper sheet. The paper sheet on which the toner image has been transferred is conveyed to a fuser 9, and consequently, the toner image is fixed on the paper sheet.

A roller 7 has a cleaning brush, and removes residual toner on the intermediate transfer belt 4 by contacting the cleaning brush to the intermediate transfer belt 4 after transferring the toner image to the paper sheet.

Figure 2:
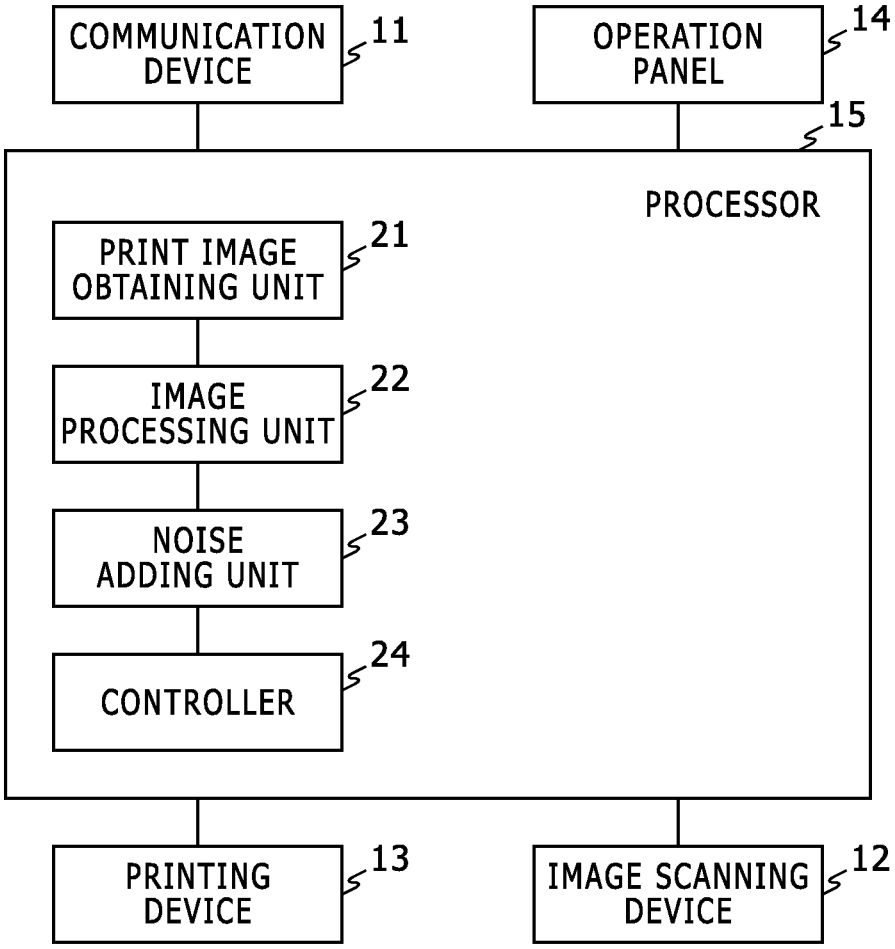
FIG. 2 shows a block diagram that indicates an electronic configuration of the image forming apparatus in the embodiment according to the present disclosure.

FIG. 2 shows a block diagram that indicates an electronic configuration of the image forming apparatus in the embodiment according to the present disclosure. As shown in FIG. 2, the present image forming apparatus includes a communication device 11, an image scanning device 12, a printing device 13, an operation panel 14, and a processor 15.

The communication device 11 is a device that is capable of connecting a host device through a network or a peripheral device interface and performs data communication according to a predetermined communication protocol.

Further, the image scanning device 12 optically scans a document image of a document and generates image data of the document image.

Furthermore, the printing device 13 is an internal device that performs printing of a document image using a mechanical configuration shown in FIG. 1.

Furthermore, the operation panel 14 is arranged on a housing of the present image forming apparatus, and includes a display device such as a liquid crystal display that displays an operation screen to a user and an input device such as a touch panel and/or a hard key that detects a user operation.

Furthermore, the processor 15 includes a computer or an ASIC (Application Specific Integrated Circuit) that includes a CPU (Central Processing Unit), a ROM (Read Only Memory), and a RAM (Random Access Memory), loads a program from an unshown storage device, the ROM or the like to the RAM, and executes the program with the CPU to embody various processing units.

In the present embodiment, the processor 15 embodies processing units such as an unshown operating system, a print image obtaining unit 21, an image processing unit 22, a noise adding unit 23, and a controller 24.

The print image obtaining unit 21 obtains image data of an image to be printed (hereinafter called as "print image"). For example, the print image obtaining unit 21 controls the communication device 11 and thereby receives a printing request (e.g. PDL (Page Description Language) data or the like) from a host device or the like, and generates image data of a print image from the received printing request. Further, for example, the print image obtaining unit 21 obtains, as image data of a print image, image data generated by the image scanning device 12.

Further, the image processing unit 22 performs predetermined image processing (e.g. color conversion, a screen process and/or the like) for the obtained image data of the print image and thereby generates print image data that has gradation of the predetermined number of bits for each color.

Further, the noise adding unit 23 adds a noise pattern to a print image obtained the image processing of the image processing unit 22. This noise pattern is a pattern obtained by two-dimensionally arranging plural noises in accordance with a predetermined rule (e.g. at regular intervals). Each of the plural noises has a local planar distribution. Specifically, each of the plural noises has a local planar distribution in which pixel values monotonically vary with a distance from a pixel having a peak pixel value.

In the present embodiment, the noise pattern is added onto a whole area of the print image.

Figure 3:
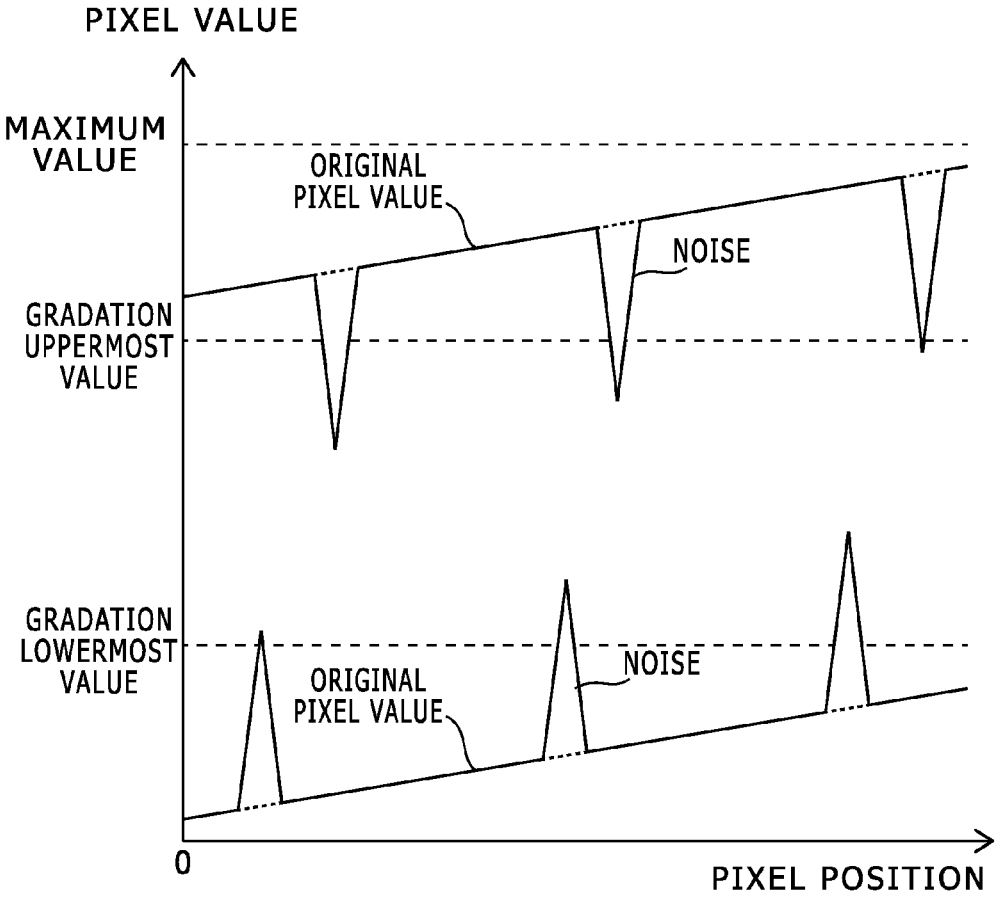
FIG. 3 shows a diagram that explains a noise added by a noise adding unit 23 shown in FIG. 2.

FIG. 3 shows a diagram that explains a noise added by a noise adding unit 23 shown in FIG. 2. As shown in FIG. 3, the aforementioned plural noises includes a positive value noise and a negative value noise; the positive value noise has a local planar distribution in which pixel values monotonically increase with a distance from a pixel having a positive peak pixel value; and the negative value noise has a local planar distribution in which pixel values monotonically decrease with a distance from a pixel having a negative peak pixel value.

It should be noted that the positive value noise is a noise in order to improve gradation in a low gradation range and the negative value noise is a noise in order to improve gradation in a high gradation range. In addition, in accordance with setting or the like, both types or only one type of the noises, i.e. the positive value noise and/or the negative value noise may be used.

FIG. 4 shows a diagram that indicates an example of a shape of the noise added by a noise adding unit 23 shown in FIG. 2. As shown in FIG. 4, each of the noises has a planar distribution with a predetermined size (in FIG. 4, 8 pixels×8 pixels), and in this planar distribution, pixel values (i.e. pixel values of the noise) monotonically (i.e. with neither multiple peaks nor a flat part) increase with a distance from a substantially center pixel having a peak pixel value (in FIG. 4, 252) from its edge (contrarily, in case of a negative value noise, monotonic decrease). In the aforementioned noise pattern, such noises are arranged two-dimensionally in accordance with a predetermined rule.

For example, the peak value of the positive value noise is set as any value that is (a) either equal to or larger than a gradation lowermost value (i.e. a lowermost value of a pixel value for which a gradation level can be obtained after change of the printing density characteristic) and (b) either equal to or less than a maximum value of a pixel value. Further, for example, the peak value of the negative value noise is set as any value that is (a) either equal to or less than a difference (having a negative value) between a gradation uppermost value (i.e. an uppermost value of a pixel value for which a gradation level can be obtained after change of the printing density characteristic) and the maximum value of a pixel value, and (b) either equal to or larger than a difference (having a negative value) between a minimum value (i.e. zero) and the maximum value of a pixel value.

By two-dimensionally arranging such noises, as shown in FIG. 3, in a print image, (a) an area less than the gradation lowermost value gets gradation because the positive value noise provides the larger number of pixels of which pixel values exceed the gradation lowermost value for a higher original pixel value, and (b) an area larger than the gradation uppermost value gets gradation because the negative value noise provides the larger number of pixels of which pixel values are less than the gradation uppermost value for a lower original pixel value.

The controller 24 is a processing unit that monitors and controls internal devices such as the printing device 13. Here the controller 24 performs printing of the print image in which the noise pattern has been added by the noise adding unit 23.

Further, the controller 24 is a processing circuit that controls an unshown driving source that drives the aforementioned rollers, a bias induction circuit that induces a development bias and a primary transfer bias, and the exposure device 2 in order to perform forming an electrostatic latent image, developing a toner image, transferring and fixing the toner image, feeding a sheet of paper, printing on the sheet, and outputting the sheet. The development biases are applied between the photoconductor drums 1*a* to 1*d* and the development units 3*a* to 3*d*, respectively. The primary transfer biases are applied between the photoconductor drums 1*a* to 1*d* and the intermediate transfer belt 4, respectively.

The following part explains a behavior of the aforementioned image forming apparatus.

The print image obtaining unit 21 obtains image data (e.g. RGB data) of a print image, and the image processing unit 22 performs the predetermined image processing for the image data.

Subsequently, the noise adding unit 23 adds the aforementioned noise pattern to the image data for which the image processing has been performed.

Using the printing device 13, the controller 24 performs printing of the print image to which the aforementioned noise pattern has been added.

In the aforementioned embodiment, the noise adding unit 23 adds a noise pattern to a print image, and the controller 24 performs printing of the print image in which the noise pattern has been added. The noise pattern is a pattern obtained by two-dimensionally arranging plural noises of which each has a local planar distribution, and each of the plural noises has a local planar distribution in which pixel values monotonically vary with a distance from a pixel having a peak pixel value.

Therefore, despite poor expression in a low density range and a high density range owing to aging of a development system as shown in FIG. 1, a gradation characteristic of the low density range and the high density range can be improved in a simple manner.

Figure 5:
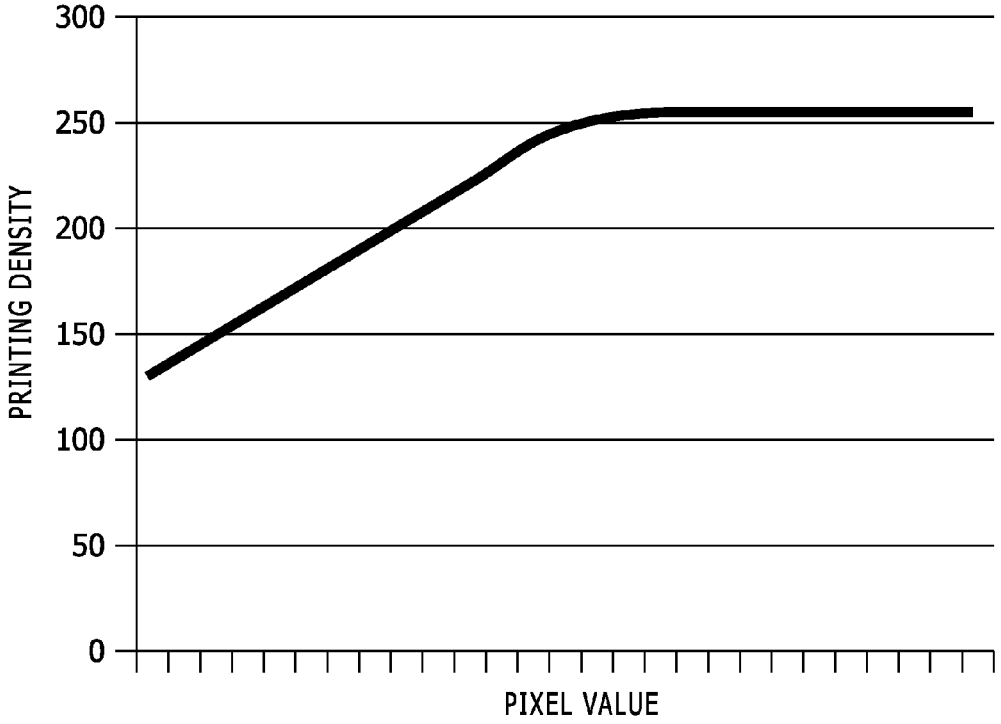
FIG. 5 shows a diagram that indicates an example of a printing density characteristic when positive value noises are added by the noise adding unit 23 shown in FIG. 2.
Figure 6:
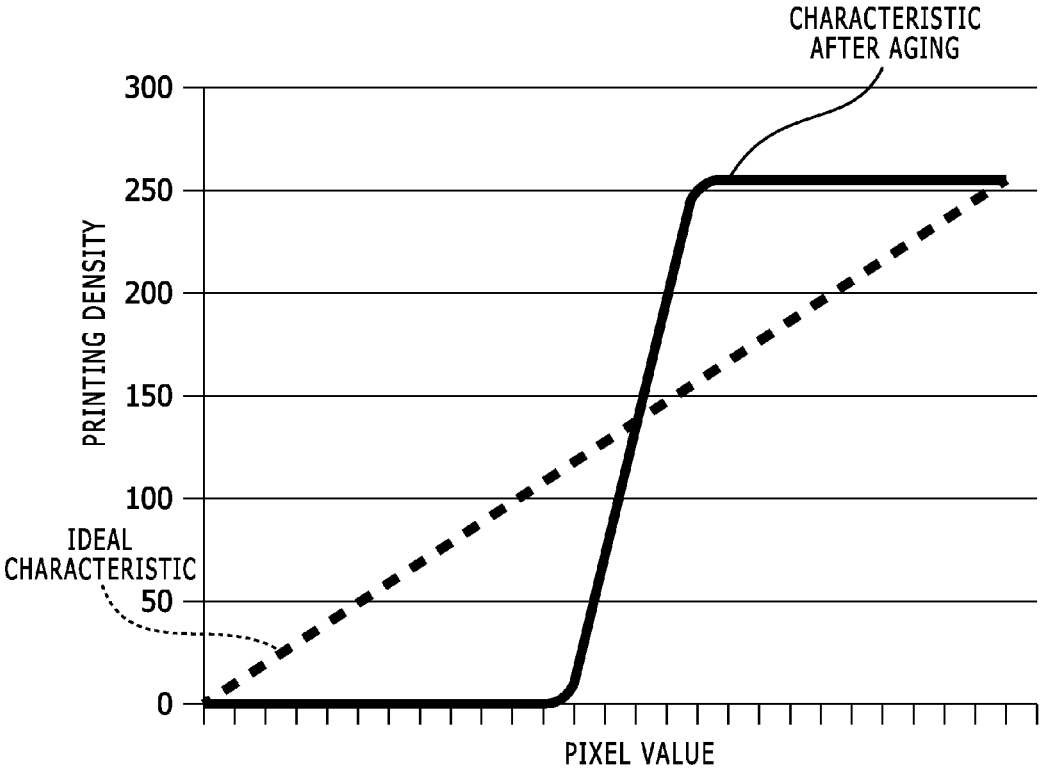
FIG. 6 shows a diagram that explains change of a printing density characteristic due to aging of a development system.

FIG. 5 shows a diagram that indicates an example of a printing density characteristic when positive value noises are added by the noise adding unit 23 shown in FIG. 2. For example, even if the printing density characteristic varied as indicated by a solid line shown in FIG. 6, adding the positive value noises improves the gradation characteristic of its low density range as shown in FIG. 5.

The description has been presented for purposes of illustration and description, and is not intended to be exhaustive or limited.

For example, in the aforementioned embodiment, the noise adding unit 23 may adjust at least one of (a) the number of the plural noises and (b) the peak pixel value in accordance with a printing density characteristic. For example, for a smaller width between the gradation uppermost value and the gradation lowermost value in the printing density characteristic, the number of the noises may get larger and/or the absolute value of the peak pixel value may get larger. For example, a user identifies a degree of change of the printing density characteristic from a printed matter, and the noise adding unit 23 may select the number of the noises and/or the peak pixel value on the basis of a user operation (i.e. a user operation indicating the degree) by the user to the operation panel 14.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a noise adding unit configured to change pixel values of image data corresponding to a print image with a noise pattern; and a controller configured to control a printing device to perform printing of the print image in which the noise pattern has been added;

wherein the noise pattern is a pattern obtained by two-dimensionally arranging plural noises of which each has a local planar distribution; and each of the plural noises has a local planar distribution in which pixel values monotonically vary with a distance from a pixel having a peak pixel value; wherein the plural noises include a positive value noise and a negative value noise; the positive value noise has a local planar distribution in which pixel values monotonically increase with a distance from a pixel having a positive peak pixel value; and the negative value noise has a local planar distribution in which pixel values monotonically decrease with a distance from a pixel having a negative peak pixel value.

2. The image forming apparatus according to claim 1 wherein the noise adding unit adjusts at least one of (a) the number of the plural noises and (b) the peak pixel value in accordance with a printing density characteristic.

3. The image forming apparatus according to claim 1 wherein the noise pattern is added onto the entire print image.

* * * * *